US006685424B1

(12) United States Patent
Ingalls

(10) Patent No.: US 6,685,424 B1
(45) Date of Patent: Feb. 3, 2004

(54) METHOD AND APPARATUS FOR INCREASING PERFORMANCE OF A PUMP

(75) Inventor: William E. Ingalls, Atascadero, CA (US)

(73) Assignee: Inga, Inc., San Luis Obispo, CA (US)

( * ) Notice: Subject to any disclaimer, the term of this patent is extended or adjusted under 35 U.S.C. 154(b) by 0 days.

(21) Appl. No.: 09/912,566

(22) Filed: Jul. 24, 2001

Related U.S. Application Data

(60) Provisional application No. 60/220,170, filed on Jul. 24, 2000.

(51) Int. Cl.[7] ..... F01D 1/02

(52) U.S. Cl. ..... 415/1; 415/198.1; 415/912; 416/198 R

(58) Field of Search ..... 415/198.1, 1, 912; 416/1, 77, 175, 198 R, 198 A, 183, 185, 200 R

(56) References Cited

U.S. PATENT DOCUMENTS

| | | | | | |
|---|---|---|---|---|---|
| 1,096,079 | A | * | 5/1914 | Viall | 416/212 R |
| 1,524,320 | A | | 1/1925 | Sparks | |
| 1,827,316 | A | * | 10/1931 | Haynsworth | 416/185 |
| 2,262,695 | A | * | 11/1941 | Moeller | 416/175 |
| 2,580,517 | A | | 1/1952 | Clifford | |
| 2,620,970 | A | * | 12/1952 | Palmer et al. | 416/175 |
| 2,760,468 | A | | 8/1956 | Dolza | |
| 2,772,852 | A | * | 12/1956 | Stalker | 416/198 R |
| 3,462,131 | A | * | 8/1969 | Hill | 416/198 R |
| 3,941,506 | A | * | 3/1976 | Robb et al. | 416/198 A |
| 4,385,594 | A | | 5/1983 | Hauser, Jr. | |
| 4,386,886 | A | | 6/1983 | Neal | |
| 4,902,199 | A | | 2/1990 | McDonald et al. | |
| 5,573,376 | A | | 11/1996 | Hayden et al. | |

* cited by examiner

*Primary Examiner*—Ninh H. Nguyen
(74) *Attorney, Agent, or Firm*—Thomas F. Labens; Sinsheimer, Schiebelhut & Baggett

(57) ABSTRACT

A method and apparatus for improving the performance of a pump uses a pump performance disk kit comprising an impeller disk having a plurality of impeller disk blades extending at angles from a planar surface of the impeller disk such that when the impeller disk is attached on top of an impeller of a pump the total number of blades for use by the pump, and thus the performance, is increased. Interior edges of the impeller disk blades are located such as to prevent rotation of the impeller disk and lock the impeller disk blades in a location approximately halfway between blades of the impeller of the pump. An anticavitation disk is also attached on top of the impeller disk to eliminate the cavitation caused by coolant spilling out the open face of the pump impeller by blocking off the open spaces between the blades.

27 Claims, 3 Drawing Sheets

METHOD AND APPARATUS FOR INCREASING PERFORMANCE OF A PUMP

This application claims priority to provisional application Ser. No. 60/220,170 of Ingalls, filed Jul. 24, 2000.

BACKGROUND

The present invention relates to pump apparatus, and more particularly to improving performance of pump apparatus that use bladed devices.

Most automotive engines, when altered to produce more power, or worked harder than originally designed for, generate more heat from the internal combustion process than the original stock cooling system was designed to disperse into the surrounding air. The increased engine operating temperature requires more water flow through the engine block in gallons per minute at low speeds than the stock water pump was designed to produce. The addition of the disk kit described below to the stock water pump impeller doubles the water flow rate at low speeds. The doubling of the water flow rate provides enough gallons per minute to prevent overheating in performance enhanced or overloaded engines.

The increase of the water flow rate lowers the engine operating temperature by exposing more gallons of engine coolant per minute to the air passing through the engine radiator. The increased coolant flow rate keeps the temperature of the engine from exceeding the manufacturer's safe operational limits during periods of low speed/high load operation.

Low speed overheating is a common problem experienced by 'hot rods', high performance cars, recreational vehicles, forklifts, police cars, mobile welding units, cars and or light duty trucks towing trailers, emergency vehicles, and older vehicles with partially restricted cooling systems that are no longer able to pass enough water through the engine block to transfer the heat of engine combustion to the air passing through the radiator efficiently enough to keep the engine temperature from increasing beyond that recommended by the manufacturer even under normal operating conditions.

When driving at highway speeds of 60 or 70 miles per hour, or roughly 2,000 to 2,500 engine rotations per minute (rpm), a typical water pump moves approximately 30 gallons of coolant per minute through the engine block and radiator to keep the engine temperature within safe operating limits. At idle (700 to 900 rpm) the same water pump only moves 5 to 6 gallons per minute through the engine and radiator. As long as there is little or no strain on the engine at these low speeds a water flow rate one fifth that found at normal highway speeds is able to adequately cool the engine.

With a heavy load on the engine at low rpm typical of a vehicle towing a loaded trailer up a long grade, or a high power 'hot rod' idling in traffic, or a fork lift repeatedly lifting heavy loads at low engine speeds, the quantity of heat generated by the combustion of fuel inside the engine is more than can be transferred by 5 or 6 gallons of water per minute to the radiator for cooling. As a result the water temperature increases until it boils, or until a stable equilibrium temperature higher than the manufacturers recommended operating temperature of the engine is reached.

Previously, the only way to increase the gallons per minute output of a stock vehicle water pump was to replace the stock pump with a custom made 'racing' or high output 'heavy duty' water pump, or remove the stock water pump and have it rebuilt by a specialized re-manufacturer with a higher output impeller. Either method is more expensive and time consuming than simply altering the existing water pump impeller in such a way as to double the water flow rate without damaging the life expectancy of the pump or incurring much expense installing the impeller conversion disk kit.

A completely new self-contained high flow rate water pump impeller could be installed in place of the stock water pump impeller, but the installation requires the forceful removal of the original press fit impeller and the press fit reinstallation of the new impeller. The equipment required to do impeller replacement properly is expensive and time consuming and unavailable to the vast majority of professional and amateur mechanics and drastically reduces the life expectancy of the rebuilt water pump due to the heavy strain the process imparts to the water pump bearings, seals, support shaft concentricity and surrounding pump body casting integrity. A water pump that starts out with a life time warranty generally ends up with a 90 day warranty after rebuilding due to the known statistical degradation of its mechanical integrity. What is needed is a quick and inexpensive way to increase a pump's performance that requires no specialized tooling and can be performed by all professional and amateur mechanics.

The present invention addresses the needs above as well as others.

SUMMARY OF THE INVENTION

The present invention addresses the above and other needs by providing a pump performance disk kit comprising an impeller disk having a plurality of impeller disk blades extending at angles from a planar surface of the impeller disk such that when the impeller disk is attached on top of an impeller of a pump the total number of blades for use by the pump, and thus the performance, is increased. An anticavitation disk is also provided for attachment on top of the impeller disk to eliminate the cavitation caused by coolant spilling out the open face of the pump stock impeller by blocking off the open spaces between the blades.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE PREFERRED EMBODIMENTS

The following description is of the best mode presently contemplated for carrying out the invention. This description is not to be taken in a limiting sense, but is made merely for the purpose of describing the general principals of the invention. The scope of the invention should be determined with reference to the claims.

Figure 1:
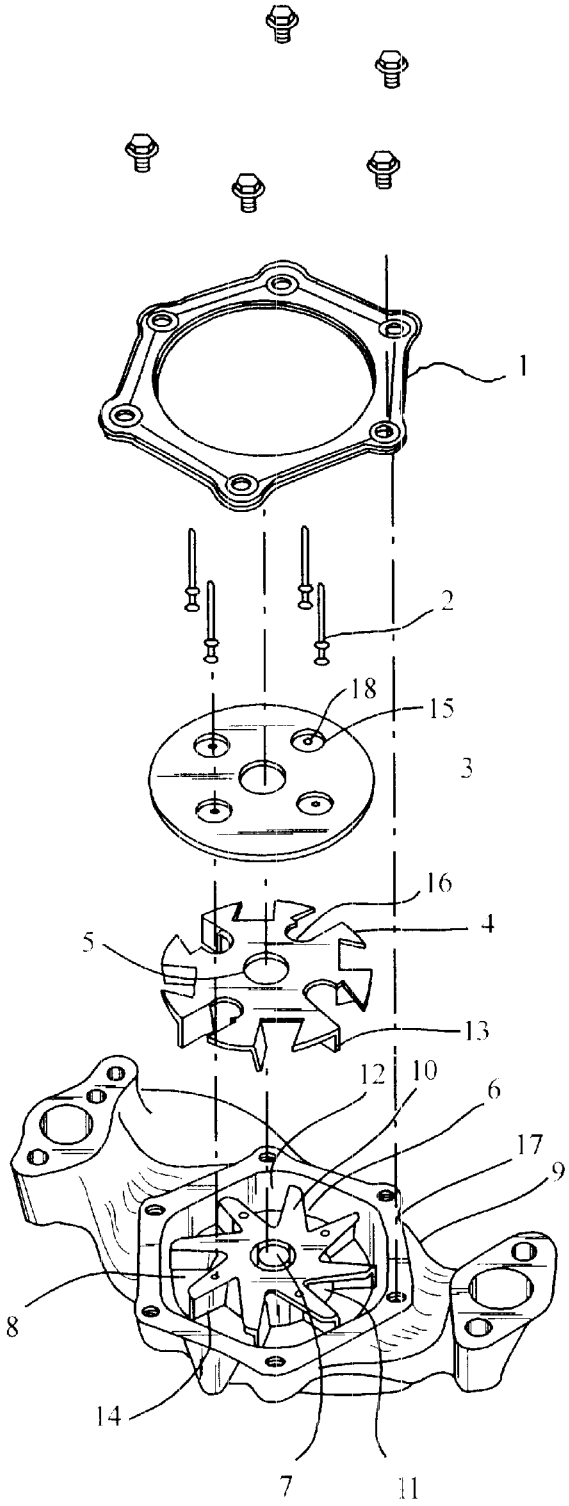
FIG. 1 is an exploded perspective view of a performance disk kit and an associated pump.

Referring to FIG. 1, shown is an exploded perspective view of a performance disk kit 2, 3, 4 and an associated pump 9. The disk kit has an impeller disk 4 and anticavitation disk 3 that, when attached to the stamped steel impeller 6 of a water cooled internal combustion engine water pump 9, increases the water flow rate of the pump at low and intermediate speeds of 700 to 3,300 rpm. The impeller disk 4 and anticavitation disk 3 can also be attached to other types of pumps to increase performance. The addition of the impeller disk 4 to the stock water pump impeller 6 doubles the number of working blades with a resultant increase in gallons per minute pumped at any given revolutions per minute.

Specifically, the addition of the anticavitation disk 3 and impeller disk 4 to a stock water pump 9 increases the gallons per minute generated by the water pump 9 at idle from 5 or 6 gallons to 10 or 12 gallons per minute, allowing enough water to flow through the engine to transfer enough heat to the radiator to keep the engine operating temperature within the manufacturers recommended limits, reducing maintenance expense and extending the operational life of the engine. The addition of the anticavitation disk 3 increases the efficiency of the pumping action up to 27%, reducing the rotational energy required to drive the pump 9 while increasing the amount of water moved by each blade of the impeller 6. Although addition of the anticavitation disk provides a further increase in performance, it is not necessary as increased performance is also obtained merely by the attachment of the impeller 4 itself.

The anticavitation disk 3 has a plurality of recessed locking dimples 15. At the center of each of the recessed locking dimples 15 in the anticavitation disk 3 is a small diameter hole 18 that allows passage of a stainless steel rivet 2 through the anticavitation disk 3 to hold both the anticavitation disk 3 and the impeller disk 4 securely to the stock water pump impeller 6. Because the recessed dimples 15 nest snugly into the impeller disk receiver holes 16, and the impeller disk 4 is located radially by its blades 13 in a precise location in relation to the blades 14 of the stock stamped steel water pump impeller 6 (see also FIG. 2), the small holes 18 located in the center of the recessed dimples 15 function as drilling guides for drilling the required mounting holes through the stock water pump impeller 6 in predetermined locations capable of securely holding the impeller disk 4 and anticavitation disk 3 mechanically in place against the stock impeller 6.

An alignment hole 5 is located in the center of both the impeller disk 4 and the anticavitation disk 3. The alignment hole 5 allows both disks to be quickly and precisely centered on the water pump shaft 7 during assembly, preventing off center assembly which could lead to an out of balance condition during operation. An out of balance assembly can produce forces that can shorten the life of the ball bearings holding the water pump shaft in place as well as compromising the water pump shaft seals that prevent coolant leakage from the engine. The quick and accurate assembly of the impeller disk and locking disk on the existing water pump impeller keeps the cost and skill required to assemble low, without decreasing the operational life expectancy of the pump.

The impeller disk 4 and anticavitation disk 3 are constructed from corrosion resistant materials such as brass, aluminum, plastic or galvanized steel to prevent rusting when exposed to the water in the cooling system. A plastic or composite injection molded disk kit could be manufactured that combined both the anticavitation disk 3 and the impeller disk 4 into a single unit, but would be subject to long term stress cracking at the attachment points and possible structural alteration by long term exposure to the chemical additives found in anti-freeze and other aftermarket rust inhibitors and cooling additives. A non-ferrous molded metal disk kit could be manufactured, but the cost would be higher than the stamped brass pieces that currently make up the components of the disk kit.

The typical automotive water pump 9 is composed of an open-faced 6 or 8 bladed stamped steel impeller 6 that rotates close against a machined surface 8 inside the body of the pump. The close proximity of leading edge of each rotating impeller blade 14 to the machined surface of the water pump 8 traps the water to be pumped against the machined surface 8 of the pump body, preventing the water from slipping back under the blade 14 as the blade moves over the machined surface. The trapped coolant is drawn into the center of the impeller 6 of the pump 9 through an access passage 11 located around the shaft 7 that supports and drives the stock impeller 6. The larger the number of blades, or the faster the blades rotate, the higher the water flow rate.

The open face side 10 of the stock water pump impeller 9, however, allows the pumped engine coolant to 'spill' over the open back of the blade 14 during operation through the open spaces 12 between each of the impeller blades, spoiling the ability of each blade to fully trap and pump all the water that is in front of it. This spillage also creates cavitation, decreasing pumping efficiency and requiring that more power be used to rotate the pump 9 than would be required if the cavitation was not present. The addition of the anticavitation disk 3 to the stock impeller 6 eliminates the cavitation caused by coolant spilling out the open face 10 of the stock impeller 6 by blocking off the open spaces 12 between the blades.

Figure 2:
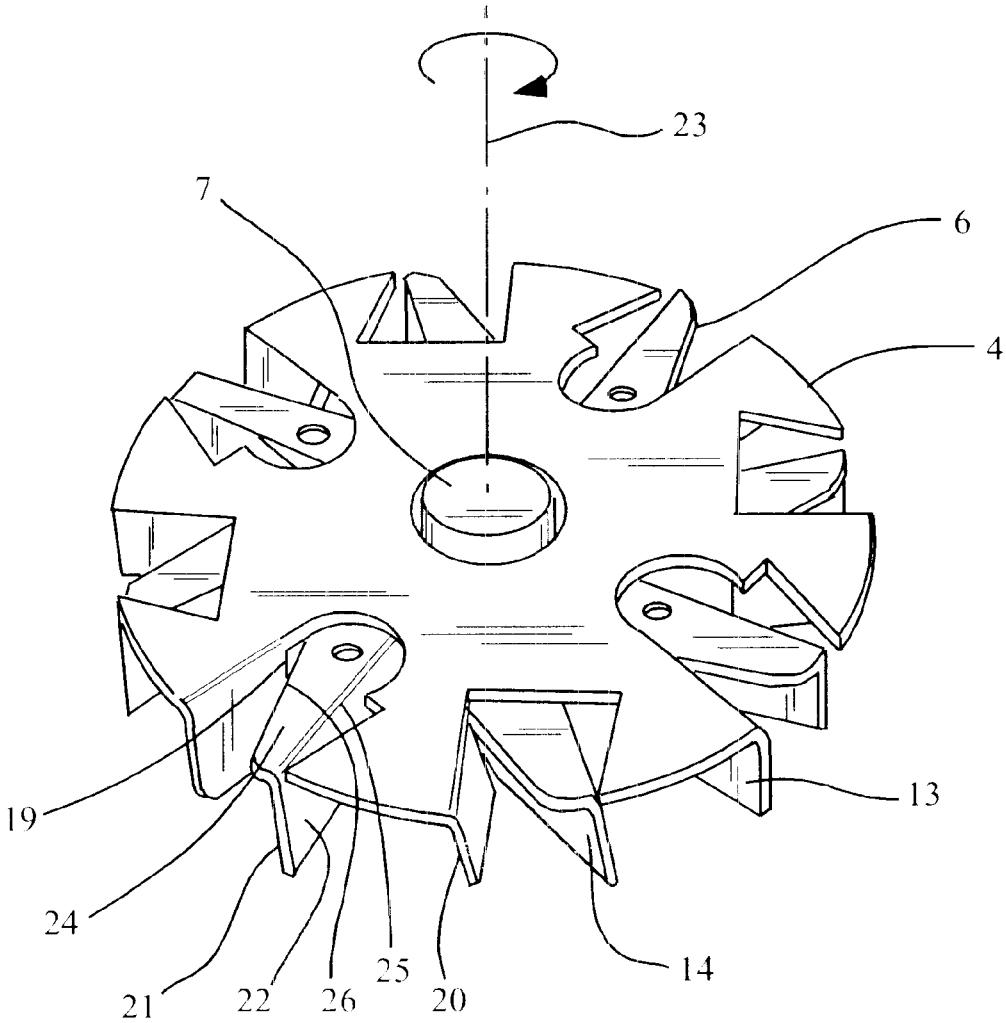
FIG. 2 is a perspective view of an impeller disk of the disk kit of FIG. 1 coupled to the pump impeller of FIG. 1.

Referring now to FIG. 2, shown is a perspective view of the impeller disk 4 of the disk kit of FIG. 1 coupled to the pump impeller 6 of FIG. 1. The addition of a 6 or 8 bladed impeller disk 4 to the stock 6 or 8 bladed water pump impeller 6 doubles the number of impeller blades pumping the water, increasing the number of working blades from 6 or 8 to 12 or 16. The blades 13 of the impeller disk 4 are shaped such that when the impeller disk 4 is dropped over the stock water pump impeller 6 and rotated prior to being riveted into place (as shown in FIG. 2), interior edges 19 of the impeller disk blades 13 engage the stock water pump impeller blades 14 in such a way as to locate the exterior edges 20 of the impeller disk blades 13 halfway between the exterior edges 21 of the pump impeller blades 14. This centered location creates an evenly spaced 12 or 16 bladed impeller. Specifically, the pump impeller 6 has blade faces 22 that are approximately parallel to the axis of rotation 23, and supporting structures 24 that are perpendicular to the axis of the rotation 23. These supporting structures 24 each have a proximal edge 25 at which the blade faces 22 meet the supporting structures 24, and distal edges 26 that lead the blade faces 22 as the pump impeller 6 rotates about the axis of rotation 23. These distal edges 26 are engaged by the interior edges 19 of the impeller disk blades 13 of the impeller disk 4 as the pump impeller 6 is rotated, thus, aligning the exterior edges 20 of the impeller disk blades 13 about half way between the exterior edges of the pump impeller blades 14. As a further result, the forces imparted to the pump impeller 6 during operation, such as forces imparted by a rotating motor or belt drive, are transferred to the impeller disk 4. Advantageously, these forces are not borne substantially by the rivets 2, which instead bear substantially only axial forces, such as those resulting from water pushing against the anticavitation disk 3.

Figure 3:
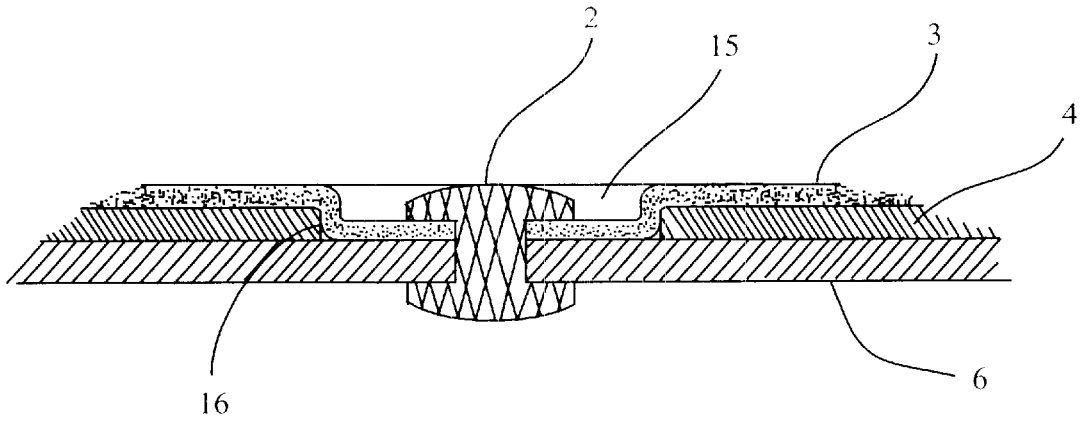
FIG. 3 is a cross sectional view of the disk kit and the pump impeller of FIG. 1 attached by a rivet.

Referring now to FIG. 3 shown is a cross sectional view of the impeller 6 of the pump 9 and the disk kit of FIG. 1 attached by a rivet. The anticavitation disk 3 and the impeller disk 4 are riveted 2 to the water pump impeller 6 one atop the other so that the whole assembly is securely fastened together and rotates in unison. The anticavitation disk 3 and the impeller disk 4 can also be spot welded 2 to the water pump impeller instead of, or in addition to, being riveted. Because the blades of the impeller disk 13 are in physical contact with the blades 14 of the water pump impeller 6, the rivets 2 holding the disk kit to the impeller are not required to take the sheer loads imparted to the impeller disk 4 by the water pressure built up in front of the impeller disk blades 13 during rotational operation. This reduces the load requirements placed on the rivet to only those required to clamp the disk kit securely to the stock water pump impeller 6.

The anticavitation disk 3 has recessed locking dimples 15 that nest into appropriately sized holes 16 in the impeller disk 4. The recessed locking dimples 15, when engaged with the holes 16 in the impeller disk 4, act to lock the two disks together to prevent slippage. The recessed locking dimples 15 also allow the attachment rivets 2 to sit low enough to be flush with the top planar surface of the anticavitation disk 3. This prevents the rivets 2 from sticking up above the surface of the nested disks and rubbing against the inside surface of the water pump backing plate 1 as the impeller assembly rotates during engine operation. Without recessed dimples 15, interference between the water pump backing plate 1 and the exposed heads of the rivets 2 can occur depending upon the amount machined off the backing plate mounting surface 17 during the manufacture of the water pump 9.

While the invention herein disclosed has been described by means of specific embodiments and applications thereof, numerous modifications and variations could be made thereto by those skilled in the art without departing from the scope of the invention set forth in the claims.

What is claimed is:

1. A pump performance disk kit for increasing liquid flow rate comprising:

an impeller disk; and a plurality of impeller disk blades extending at angles from a planar surface of the impeller disk such that when the impeller disk is attached on top of an impeller of a pump a total number of blades for use by the pump is increased and wherein the interior edges of the impeller disk blades are located such that when the impeller disk is attached on top of the impeller of the pump the interior edges of the blades contact the impeller of the pump to prevent rotation of the impeller disk and lock the impeller disk blades.

2. The pump performance disk kit according to claim 1 wherein interior edges of the impeller disk blades are located such that when the impeller disk is attached on top of the impeller of the pump the interior edges of the blades contact the impeller of the pump to prevent rotation of the impeller disk and lock the impeller disk blades in a location approximately halfway between blades of the impeller of the pump.

3. A pump performance disk kit for increasing liquid flow rate comprising:

an impeller disk;

a plurality of impeller disk blades extending at angles from a planar surface of the impeller disk such that when the impeller disk is attached on top of an impeller of a pump a total number of blades for use by the pump is increased; and an anticavitation disk for attachment on top of the impeller disk.

4. The pump performance disk kit according to claim 3 wherein the anticavitation disk is approximately the same diameter as the impeller disk.

5. The pump performance disk kit according to claim 3 wherein interior edges of the impeller disk blades are located such that when the impeller disk is attached on top of the impeller of the pump the interior edges of the blades contact the impeller of the pump to prevent rotation of the impeller disk and lock the impeller disk blades in a location approximately halfway between blades of the impeller of the pump.

6. The pump performance disk kit according to claim 5 wherein the anticavitation disk is approximately the same diameter as the impeller disk.

7. The pump performance disk kit according to claim 6 wherein the anticavitation disk has a plurality of recessed locking dimples such that when nested into an equal number of holes in the impeller disk slippage of the anticavitation disk and impeller disk is prevented when attached to the impeller of the pump.

8. The pump performance disk kit according to claim 7 wherein the recessed dimples allow rivets to be attached through the recessed dimples to the impeller disk and the impeller of the pump such that the rivets are flush with a planar surface of the anticavitation disk.

9. The pump disk kit according to claim 8 wherein the impeller disk has an alignment hole located in the center of the impeller disk and the anticavitation disk has an alignment hole located in the center of the anticavitation disk.

10. An improved pump of the type having a pump impeller, wherein the improvement comprises:

an impeller disk having a plurality of impeller disk blades attached on top of the pump impeller such that a total number of blades used by the pump is increased and liquid flow rate is increased and wherein interior edges of the impeller disk blades are located such that when the impeller disk is attached on top of the impeller of the pump the interior edges of the blades contact the impeller of the pump to prevent rotation of the impeller disk and lock the-impeller disk blades.

11. The improved pump according to claim 10 wherein interior edges of a plurality of impeller disk blades of the impeller disk contact the pump impeller to prevent rotation of the impeller disk and lock the impeller disk blades in a location approximately halfway between blades of the pump impeller.

12. An improved pump of the type having a pump impeller, wherein the improvement comprises:

an impeller disk attached on top of the pump impeller such that a total number of blades used by the pump is increased and liquid flow rate is increased; and an anticavitation disk attached on top of the impeller disk.

13. The improved pump according to claim 12 wherein the anticavitation disk is approximately the same diameter as the impeller disk.

14. The improved pump according to claim 13 wherein the anticavitation disk is attached on top of the impeller disk by means of a plurality of recessed locking dimples that are nested into an equal number of holes in the impeller disk whereby slippage of the anticavitation disk and impeller disk is prevented.

15. The improved pump according to claim 14 wherein the recessed dimples have rivets attached through the recessed dimples to the impeller disk and pump impeller such that the rivets are flush with a planar surface of the anticavitation disk.

16. The improved pump according to claim 15 wherein the impeller disk has an alignment hole located in the center of the impeller disk and the anticavitation disk has an alignment hole located in the center of the anticavitation disk.

17. A method for improving the liquid flow rate of a pump comprising the step of attaching an impeller disk on top of an existing impeller of the pump such that a total number of blades used by the pump is increased and liquid flow rate is thereby increased.

18. The method according to claim 17 wherein interior edges of blades of the impeller disk are located such that when the impeller disk is attached on top of the impeller of the pump the interior edges of the blades contact the impeller of the pump to prevent rotation of the impeller disk and lock the impeller disk blades in a location approximately halfway between blades of the impeller of the pump.

19. A method for improving the liquid flow rate of a pump comprising the steps of:

attaching an impeller disk on top of an existing impeller of the pump such that a total number of blades used by the pump is increased and liquid flow rate is thereby increased; and attaching an anticavitation disk on top of the impeller disk.

20. The method according to claim 19 wherein the anticavitation disk is approximately the same diameter as the impeller disk.

21. The method according to claim 20 wherein the anticavitation disk attaching step comprises the steps of:

nesting the anticavitation disk having a plurality of recessed locking dimples into an equal number of holes in the impeller disk such that slippage of the anticavitation disk and impeller disk is prevented; and riveting the anticavitation disk through the recessed dimples to the impeller disk and the impeller of the pump such that the rivets are flush with a planar surface of the anticavitation disk.

22. A pump performance disk kit comprising:

an impeller disk; and a plurality of impeller disk blades extending at angles from a planar surface of the impeller disk such that when the impeller disk is attached on a planar surface of an existing inner pump impeller the impeller disk blades extend axially from the impeller disk in the direction of the inner existing pump impeller and a total number of blades for use by a pump is increased and wherein the interior edges of the impeller disk blades are located such that when the impeller disk is attached on top of the inner pump impeller the interior edges of the blades contact the inner pump impeller to prevent rotation of the impeller disk and lock the impeller disk blades.

23. The system of claim 22 further comprising a shaft extending from the existing inner pump impeller disk in a same direction as the impeller disk blades of the impeller disk.

24. An improved pump of the type having a pump impeller, wherein the improvement comprises:

an impeller disk attached on a planar surface of an existing inner pump impeller wherein blades of the impeller disk extend axially from the impeller disk in the direction of the inner existing pump impeller such that a total number of blades used by the pump is increased and wherein the interior edges of the impeller disk blades are located such that when the impeller disk is attached on top of the inner pump impeller the interior edges of the blades contact the inner pump impeller to prevent rotation of the impeller disk and lock the impeller disk blades.

25. The improved pump of claim 23 further comprising a shaft extending from the existing inner pump impeller disk in a same direction as the impeller disk blades of the impeller disk.

26. A method for improving the performance of a pump comprising the step of: providing the pump having an existing inner pump impeller; and attaching an impeller disk on a planar surface of the existing inner pump impeller wherein blades of the impeller disk extend axially from the impeller disk in the direction of the inner existing pump impeller such that a total number of blades used by the pump is increased.

27. The method of claim 26 wherein said providing includes providing the pump having the existing inner pump impeller, wherein the inner pump impeller comprises a shaft extending from the existing inner pump impeller in a same direction as the impeller disk blades of the impeller disk.

* * * * *